United States Patent [19]

Di Meo

[11] 4,139,925

[45] Feb. 20, 1979

[54] DOOR HINGE, PARTICULARLY FOR REFRIGERATORS

[75] Inventor: Alberto Di Meo, Milan, Italy

[73] Assignee: Internica S.p.A., Italy

[21] Appl. No.: 800,310

[22] Filed: May 25, 1977

[51] Int. Cl.[2] ..... E05D 7/02; E05D 5/10

[52] U.S. Cl. ..... 16/170; 16/153; 16/168; 49/382

[58] Field of Search ..... 16/170, 168, 176, 153, 16/139; 49/382, 193; 312/329

[56] References Cited

U.S. PATENT DOCUMENTS

| | | | |
|---|---|---|---|
| 2,701,384 | 2/1955 | Barroero | 16/168 X |
| 3,065,035 | 11/1962 | Biesecker | 312/329 UX |
| 3,396,490 | 8/1968 | Dukas | 49/382 |
| 3,488,667 | 1/1970 | Gutshall | 16/139 |
| 3,722,031 | 3/1973 | Bourgeois | 16/153 |
| 3,748,688 | 7/1973 | Berkowitz | 16/153 |

FOREIGN PATENT DOCUMENTS

| | | | |
|---|---|---|---|
| 663524 | 1/1965 | Belgium | 16/168 |
| 2524268 | 12/1976 | Fed. Rep. of Germany | 16/153 |

*Primary Examiner*—James Kee Chi

*Attorney, Agent, or Firm*—Steinberg & Blake

[57] ABSTRACT

Hinge, particularly for refrigerator or freezer doors, comprising a first member for attachment to a stationary part, a pin mounted in the first member and projecting therefrom, a hole in the first member spacedly surrounding the pin and defining an annular gap closed at one end by a cam surface, a second member for attachment to the door, a housing in the second member, an axially bored insert, partly and removably mounted in the housing so as to be prevented from rotating and having a front surface bearing on the first member, the pin being receivable in the axial hole of the insert, and means in the second member for alternately securing it to the door at two opposite faces thereof.

8 Claims, 10 Drawing Figures

DOOR HINGE, PARTICULARLY FOR REFRIGERATORS

This invention relates to a design of hinge which is particularly, even though not exclusively, suited for doors in refrigerators (such as large refrigerators or industrial freezers).

A conventional hinge for industrial refrigerators cannot be mounted on both rightward opening doors and leftward opening doors without removing or changing the position of some of the components and without turning it over, that is passing from righthand to lefthand mounting, or vice versa. Furthermore, such hinges, where designed for causing the door to be lifted when being opened, cannot be readily modified to prevent such an opening from being coupled by a lifting effect.

It is an object of the present invention to provide a hinge which can be readily applied to both righward and leftward opening doors without removing or changing the position of some of the components and without the hinge having to be turned over.

It is another object of the present invention to provide such a hinge that by merely replacing one part or component can be converted from rotating and lifting hinge to simply rotating hinge and vice versa.

It is still another object of the present invention to provide a simple, inexpensive and readily installed hinge.

These and other objects, which will become more apparent from the following detailed description, are attained by a hinge comprising a first member intended to be connected to a stationary section, a pin mounted in said first member and projecting therefrom, a hole in said first member spacedly surrounding said pin and defining an annular gap closed at one end by a liner surface, a second member intended to be secured to the door, a housing in said second member, an insert which is axially bored and partly mounted in said housing, so as to be prevented from rotating and having a front surface for bearing on said first member, said pin being capable of slipping into the axial hole of said insert, and means in said second member for alternately securing it to the door at opposing faces thereof.

The invention will be better understood from the following detailed description, given by mere way of unrestrictive example, of a preferred embodiment thereof as shown in the accompanying drawings, in which.

Figure 1:
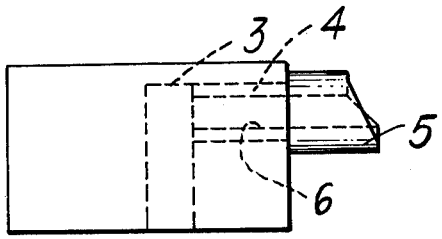
FIG. 1 is a schematic side elevational view showing one of the hinge members or blocks, namely that intended to be secured to the door.
Figure 2:
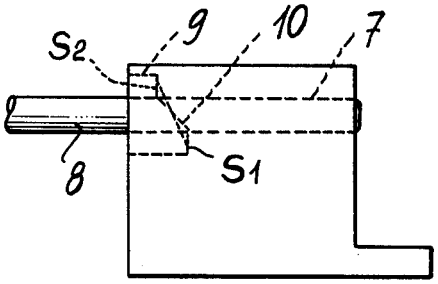
FIG. 2 is a schematic side elevational view showing the other hinge member or block, namely that intended to be secured to the doorpost or other stationary section.

FIGS. 1 through 4 schematically show the hinge, and the other figures show the hinge as actually carried into effect.

The hinge comprises two blocks 1 and 2, respectively intended to be secured by means of screws to the door and doorpost or stationary section, relative to which the door is to rotate.

Block 1, as made for example of die-cast metal, comprises a passage or hole 3 of polygonal cross-section, wherein a spigot or shank 4 can be removably inserted, this spigot or shank being of a shape corresponding to a front cam 5 having a cylindrical peripheral contour. An axial cylindrical hole 6 passes through said cam and spigot or shank. Preferably, this cam with spigot or shank is made of nylon.

Block 2, as made for example of die-cast metal, has a hole 7, wherein a pin 8 is forcibly fitted, the pin forming the hinge pivot and cantilever projecting from the block at one end. At such an end, said block 2 has a length of increased diameter 9 generating a hollow cam-shaped step 10 in bore 7 of block 2. The shapes of front cam 5 and step 10 correspond in that the countours thereof are identical, but rotated through 180° relative to each other when the door is closed.

The diameter of section 9 of hole 7 is substantially coincident with that of the contour of cam 5 which is at least partly accommodated within section 9 for rotation. The diameter of pin 8 is substantially coincident with hole 6 passing through said cam 5. The projecting portion of pin 8 is intended for insertion in said hole 6.

Figure 5:
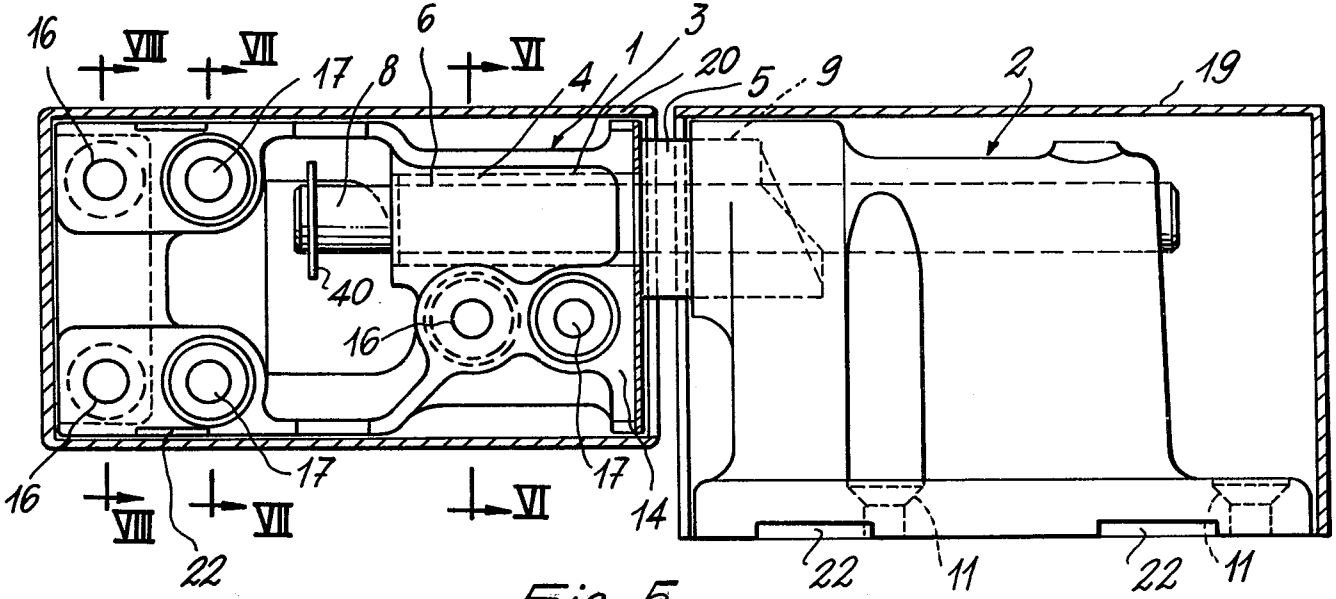
FIG. 5 is a side view showing a constructive form of the hinge, with covering shells cut away.

When developed on a plane, the profile for said two cams 5 and 10 is as shown in FIG. 5. Such a profile comprises two sloping sections or lengths S interposed between two planar sections or lengths $S_1$ and $S_2$.

Figure 3:
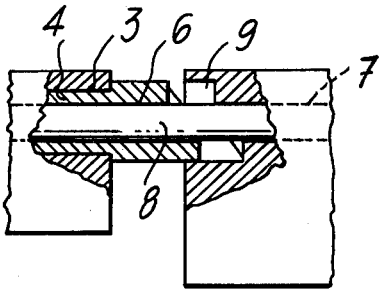
FIG. 3 is partly a side view and partly an axial sectional view showing the two hinge blocks engaged with each other.
Figure 4:
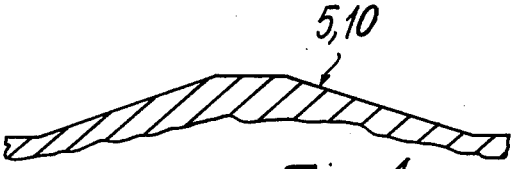
FIG. 4 is a developed plan view of the cam profile.

Upon securing block 2 to the doorpost and block 1 to the door, the connection between the two blocks is accomplished by inserting said pin 8 in hole 6, so that also cam 5 enters said section 9. In FIG. 3, there is shown a connection step, wherein pin 8 is in hole 6, and cam 5 is about to enter section 9. Coupling being accomplished, a resilient stop ring 40 is placed in a groove formed on the end of pin 8.

Upon rotation of the door and accordingly of block 1, the two cams coact, so that concurrently with rotation, a displacement or removal between the two blocks occurs in the direction of the geometrical axis of pin 8.

The two sloping sections S of the cams are symmetrical, so that by rotating, for example block 1 in either direction, the same axial displacement is provided.

The hinge allows the door to be opened by more than 180°; for the first ¾ of the run, the door is lifted, whereas for the remaining fourth it rotates without any vertical movements. Door lifting is related to the opening angle. At a same angle of rotation, lifting is the same both at rightward and leftward opening.

Block 2 is attached to doorpost 12 by screws and to this purpose suitable holes 11 are drilled in the block contour.

Also by means of screws or the like, block 1 can be secured to a rightward opening door 13 or to a leftward opening door 13A without removing or changing the position of any component and without having to turn the hinge over.

Figure 6:
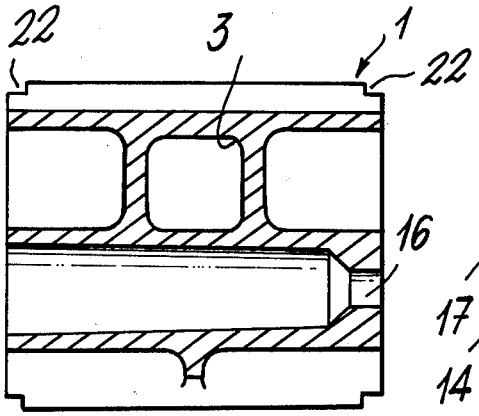
FIGS. 6, 7 and 8 are sectional views taken along lines VI—VI, VII—VII and VIII—VIII of FIG. 5, respectively.
Figure 7:
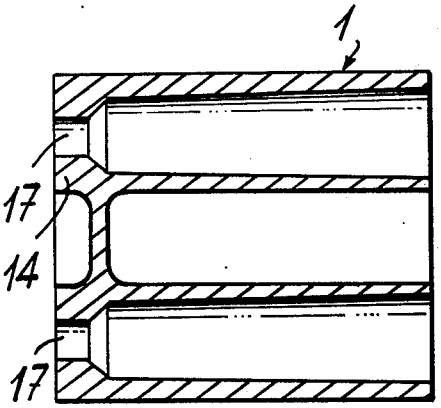
Figure 8:
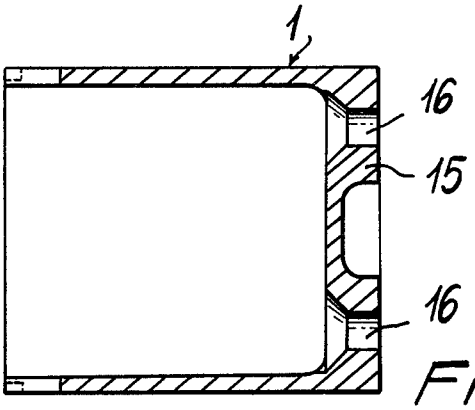

To this purpose, as clearly shown in the sectional views of FIGS. 6, 7 and 8, of countersunk holes 16 and 17, are provided in the two opposite side faces 14 and 15, the screws being threaded through such holes.

In one case, the holes 16 will be used, and in the other case to the hole 17.

Reference numeral 18 designates resilient seals secured to doorpost 12, against which door 13 is brought in pressing relation for sealing purposes. As apparent, the seals could be likewise mounted on the door.

The two blocks 1 and 2 are covered by two box-like shells or housings 19 and 20 of plastics material and opened on one longitudinal side and one end, having along the contour of one open side tooth-like elements 21 for snap fitting in notches or seats 22 in said blocks. For each of the two blocks, said shells or housings can be mounted either at the right or at the left so as to cover the exposed sides.

Figure 10:
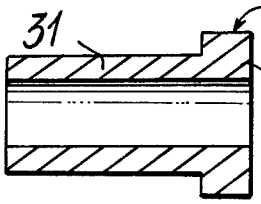
FIG. 10 is an axial sectional view showing an insert that can replace the cam insert shown in the hinge of the preceding figures.

The same hinge, without changing the overall size and attachment, is also fitted for door opening without lifting. To this end, one needs only to remove cam 5 from hole 3, wherein it is accommodated, and replace it with an insert 30 shown in the sectional view of FIG. 10. This insert has a tang 31 identical to tang or shank 4 of cam 5, a cylindrical head 32 having a flat front surface and an axial hole for receiving pin 8 therethrough. The diameter of head 32 can be larger than or equal to that of section 9. In the former case, the head will bear against the contour of section 9 and will be of less axial length; in the latter case, it will be of a larger axial length and bear against the surface $S_2$ of cam 10.

Figure 9:
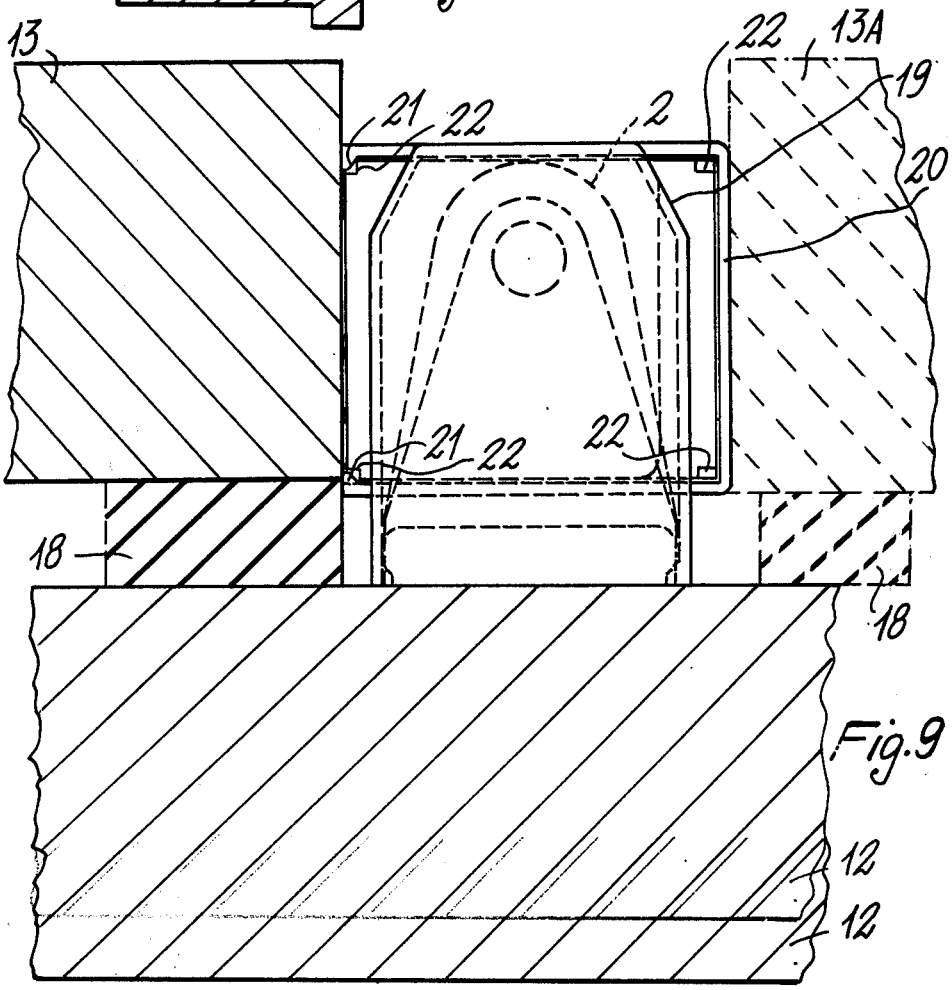
FIG. 9 is a schematic fragmentary horizontal sectional view showing a door and doorpost with the hinge as seen from the bottom.

In connection with the shells 19 and 20, it will be seen from FIGS. 5 and 9 that the housing or shell 20 for the block 1 is open at its left longitudinal side as view in FIG. 9, and at its bottom end, as viewed in FIG. 9 and as shown at the right end of shell 20 in FIG. 5, the closed top end of shell 20 being shown at the left of FIG. 5. FIG. 9 shows that for the door 13 the left recesses 22 of block 1 receive the projections 21 of housing or shell 20, whereas the right recesses 22 of FIG. 9 are not utilized for the door 13. However, when the door 13 A is used, the position of the housing or shell 20 is reversed so that the projections 21 as shown at the left in FIG. 9 are received in the recesses 22 shown at the right in FIG. 9. The housing or shell 19 for the block 2 remains in the position shown in FIGS. 5 and 9 irrespective of whether a door 13 or a door 13 A is used, this shell 19 having an open top end and a closed bottom end while being open along one side which is situated directly next to the component 12.

It will be seen that with the structure of the invention the block 2 forms a support block adapted to be fixed to a stationary structure such as the structure 12 as shown in FIG. 9, while the block 1 forms a door block adapted to be edge mounted at an edge region of a door such as the door 13 or the door 13A, the cam 5 and the pin 8 as well as the bore 7 and opening 9 of block 2 and bore 3 of block 1 and bore 6 of cam 5 forming a connecting means for connecting the door block 1 to the support block 2 above the latter for turning movement with respect thereto about a hinge axis while enabling the door block 1 to turn with respect to the support block 2 from a door-closing position in either direction to a door-open position, the support block 1 being formed on one side with openings 16 for fastening members adapted to connect the door block 1 to a right-handed door and on the opposite side with openings 17 for fastening members adapted to connect the block 1 to an edge region of a left-handed door. Of course the construction of cam 5 and recess 9 is such that the door block 1 together with a door fastened thereto can be turned in either direction from the door-closing position through 180°, with the structure of cam 5 and cam recess 9 being such that the door will be released and will be capable of remaining in its open position as well as remaining in its closed position while the cam structure operates to complete the closing of the door once the lower flat portion of cam 5 moves beyond the upper flat portion of the recess 9 from the door-opening to the door-closing position. When cam 5 is replaced by the element 30 of FIG. 10 the same operations will be achieved except that the door will not be raised.

Although only one embodiment of the invention has been described, those skilled in the art will now readily devise many changes and modifications, but which are all to be intended as within the scope of the invention.

What is claimed is:

1. A hinge comprising a support block adapted to be fixed to a stationary structure which is to be closed, said support block having an upper end, and a door block adapted to be fixed in an edge-mounted position to a door which is to be turned between closed and open positions, said door block having a lower end, said support block upper end being situated adjacent and beneath said door block lower end, said door block when fastened in an edge-mounted manner to a door being situated over said support block when the latter is fastened to a stationary structure, and connecting means connecting said blocks to each other to support said door block on said support block for turning movement with respect thereto about a vertical hinge axis, said door block having opposite sides one of which is formed with openings for receiving fastening members for fastening said door block in edge-mounted relation to a right-hand door and the other of which is formed with openings for receiving fastening members for fastening said door block in edge-mounted relation to a left-handed door, so that the position of said blocks with respect to each other remains unchanged irrespective of whether said door block is fastened to a right-hand door or a left-hand door and one of said support and door blocks being formed at said end thereof with a recess while the other said block carries at said end thereof a projection received in said recess, said projection and recess forming part of said connecting means for connecting said door-block to said support block for turning movement with respect thereto about said hinge axis.

2. The combination of claim 1 and where said projection terminates in an end camming surface which surrounds said axis while said recess terminates in an identical end camming surface which also surrounds said axis, and said camming surfaces remaining stationary with respect to the blocks so that the camming surface of said door block turns with the latter and with respect to the camming surface of said support block, each camming surface having with respect to said axis a pair of diametrically opposed flat portions respectively situated in planes normal to said axis and at different elevations with respect to said axis while each camming surface has a pair of opposed inclined portions connecting said flat portions thereof, so that each block has a lower flat portion and a higher flat portion, the lower flat portion of the camming surface of said door block engaging the lower flat portion of the camming surface of said support block when said door block is in a door-closing postion while said door block is turnable with respect to said door block through 180° in one direction or the other to a door-open position where said lower flat portion of said camming surface of said door block is situated on the upper flat portion of the camming surface of said support block, whereby a door fixed to said door block will be raised while turning to an open position and will stably remain in said open position.

3. The combination of claim 2 and wherein that one of said blocks which carries said projection is formed with a bore while an elongated member is fixed to said projection and is received removably in said bore, and a second elongated member having a second projection fixed thereto and capable of being received in said bore to replace the first mentioned elongated member and first-mentioned projection, said second projection terminating in an end face which is normal to said hinge axis so that when said second elongated member and projection are connected to said one block said second projection can be received in said recess of the other block to provide for turning of the door block with respect to said support block without raising said door block and a door connected thereto.

4. The combination of claim 3 and wherein said bore is of a non-circular cross section while said first-mentioned and second elongated members have outer surfaces of a matching non-circular cross section.

5. The combination of claim 3 and wherein each of said projections and said elongated member connected thereto are formed with a common axial bore passing therethrough and the other of said blocks carrying a hinge pin which is received in said common axial bore.

6. The combination of claim 1 and wherein a pair of hollow shells each of which is open at one side and at one end respectively extend around and cover said blocks when the latter are respectively fastened to a supporting structure and a door, the open ends of said shells being situated next to each other while the open sides of said shells are situated next to the components to which the blocks are respectively fixed.

7. The combination of claim 6 and wherein each of said shells is provided with inwardly extending projections at an edge region of each shell which defines an open side thereof, and each of said said blocks being formed with recesses into which said shell projections can snap.

8. The combination of 7 and wherein said door block is formed with said recesses at opposite sides of said door block for cooperating with said projections of said shell which covers said door block irrespective of whether said door block is fastened to a right-handed or a left-handed door.

* * * * *